US008106735B2

(12) United States Patent
Li

(10) Patent No.: US 8,106,735 B2
(45) Date of Patent: Jan. 31, 2012

(54) ELECTROMAGNETIC ATTACHMENT APPARATUS

(75) Inventor: Zhan-Yang Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 424 days.

(21) Appl. No.: 12/511,270

(22) Filed: Jul. 29, 2009

(65) Prior Publication Data

US 2010/0289606 A1 Nov. 18, 2010

(30) Foreign Application Priority Data

May 15, 2009 (CN) ..... 2009 1 0302354

(51) Int. Cl.
*H01F 7/20* (2006.01)
*H01F 7/04* (2006.01)

(52) U.S. Cl. ..... 335/294; 335/289; 335/293; 335/295

(58) Field of Classification Search ..... 335/126, 335/289–295
See application file for complete search history.

(56) References Cited

U.S. PATENT DOCUMENTS

| | | | | |
|---|---|---|---|---|
| 5,220,301 | A * | 6/1993 | Haas et al. | 335/278 |
| 6,331,810 | B1 * | 12/2001 | Jung | 335/288 |
| 6,380,831 | B1 * | 4/2002 | Kajino | 335/127 |
| 6,879,231 | B2 * | 4/2005 | Menard | 335/289 |
| 7,401,483 | B2 * | 7/2008 | Dimig et al. | 70/277 |
| 2002/0053961 | A1 * | 5/2002 | Kajino | 335/126 |
| 2002/0135449 | A1 * | 9/2002 | Menard | 335/289 |
| 2006/0232367 | A1 * | 10/2006 | Shen | 335/289 |

* cited by examiner

*Primary Examiner* — Elvin G Enad
*Assistant Examiner* — Alexander Talpalatskiy
(74) *Attorney, Agent, or Firm* — Altis Law Group, Inc.

(57) ABSTRACT

An electromagnetic attachment apparatus includes a power supply, an electromagnet module, and a rotatable module. The electromagnet module includes a coil and a core positioned in the coil. A mounting panel is attached to the core. A pair of electrically conductive blocks is attached to the mounting panel, and connected to the coil. The rotatable module is rotatably attached to the mounting panel, and includes a pair of electrically conductive pins connected to positive and negative electrodes of the power supply respectively. The rotatable module is rotatable to a first position in which the electrically conductive pins thereof contact the electrically conductive blocks for attaching a metal object, or a second position in which the electrically conductive pins thereof disengage from the electrically conductive blocks for releasing the metal object.

14 Claims, 5 Drawing Sheets

ELECTROMAGNETIC ATTACHMENT APPARATUS

BACKGROUND

1. Technical Field

The present disclosure relates to attachment apparatus, and particularly to an electromagnetic attachment apparatus.

2. Description of Related Art

In deformation test of an electronic device, such as a server, the server should be held up by some holding fixtures. A testing device is located under the server and testing probes of the testing device can detect a maximum deformation of the chassis of the server when all components of the server are installed in the chassis. The holding fixture can just hold up the chassis at an appropriate horizontal height, but cannot prevent the chassis from moving horizontally. In order to prevent the movement of the chassis, a mounting apparatus is also needed. Typical mounting apparatus usually includes fasteners, such as tie wraps, alligator cannular lips, and others. However, it's inconvenient to attach or detach the metallic frame of the chassis using typical fasteners.

Therefore, an attachment apparatus capable of more easily attaching or detaching the metal objects is desired.

DETAILED DESCRIPTION

Figure 1:
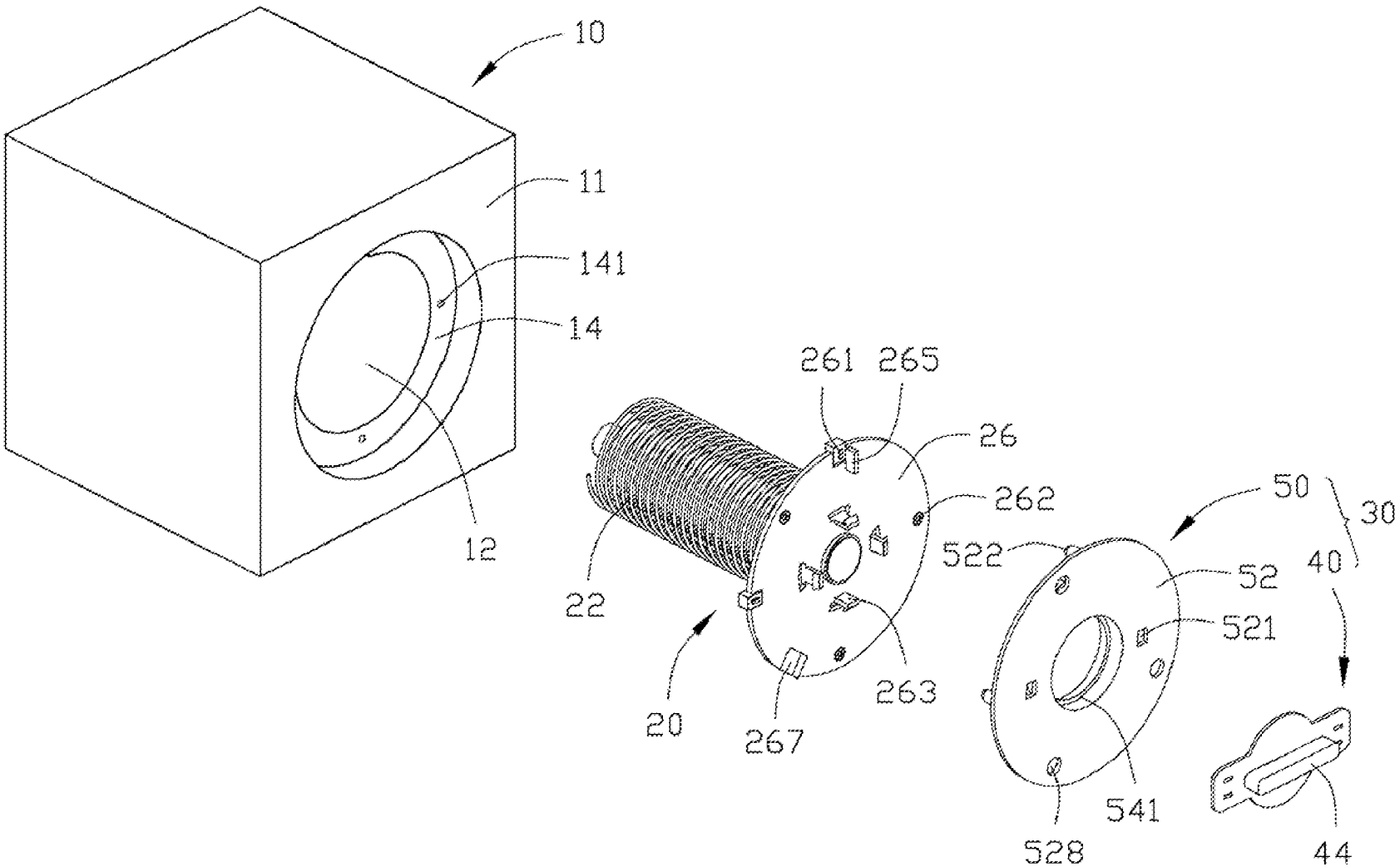
FIG. 1 is an exploded, isometric view of an electromagnetic attachment apparatus.
Figure 2:
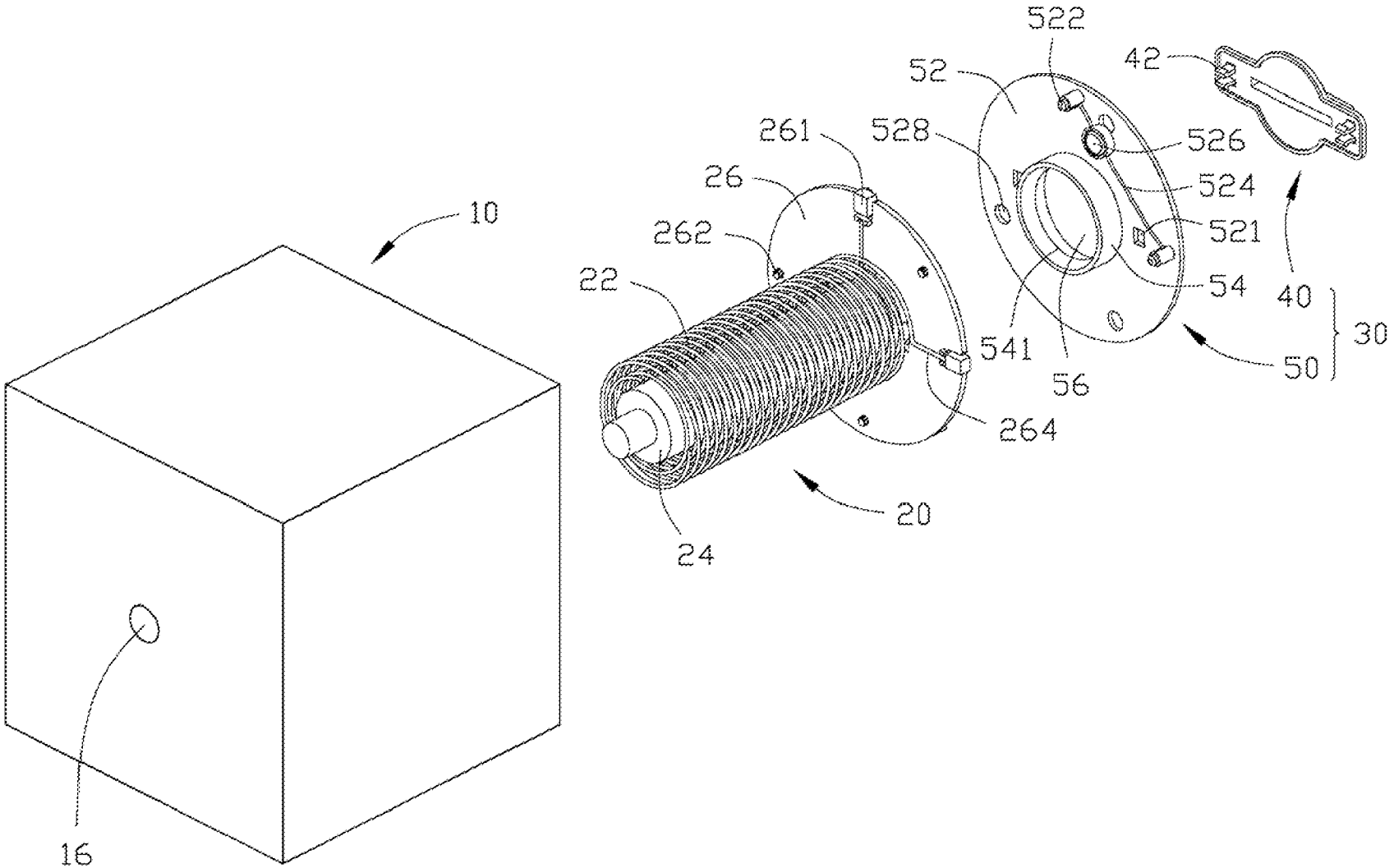
FIG. 2 is another view of FIG. 1.

Referring to FIGS. 1 and 2, an embodiment of an electromagnetic attachment apparatus includes a metal holder 10, an electromagnet module 20, and a rotatable module 30 attached to the electromagnet module 20.

The metal holder 10 is cuboid. An internal annular lip 14 and an inner receiving hole 12 coaxial with the annular lip 14 are defined in the metal holder 10. A diameter of the annular lip 14 is greater than that of the diameter of the receiving hole 12. A plurality of securing holes 141 is defined in a base portion of the annular lip 14.

The electromagnet module 20 includes a coil 22, a core 24 inside the coil 22, and a mounting panel 26 attached to an front end of the core 24. The mounting panel 26 is non-conductive material, such as plastic. A pair of electrically conductive blocks 261 is attached to the mounting panel 26 and connects with the coil 22 via wires 264. A plurality of fasteners 262 is attached to the mounting panel 26 and configured to engage the securing holes 141 of the metal holder 10. A plurality of first resilient hooks 263 protrudes from a central portion of the mounting panel 26 around the front end of the core 24. The resilient hooks 263 are positioned in a circle with its center coaxial with the center of the mounting panel 26. A first limiting member 265 and a second limiting member 267 protrude from the mounting panel 26. The first limiting member 265 is adjacent to one of the electrically conductive blocks 261.

The rotatable module 30 includes a control 40 and a rotatable panel 50. The control 40 includes a central circular portion and a pair of end protrusions protruding from opposite sides of the central circular protion. A pair of second resilient hooks 42 (FIG. 2) protrudes from an interior of each of the end protrusions inwardly. An operating portion 44 protrudes from an exterior of the circular portion of the control 40.

A main body 52 of the rotatable panel 50 is circular. A pair of mounting holes 521 is defined in the main body 52 for engaging the second hooks 42 of the control 40. A cylinder 54 protrudes from a central portion of the rotatable panel 50 inwardly. A circular guideway 541 is formed in the cylinder 54 for the first hooks 263 of the mounting panel 26 of the electromagnet module 20 to slide on. A diameter of the circular guideway 541 is approximately equal to that of the circle at which the first hooks 263 are positioned. A plurality of through holes 528 is defined in the main body 52 of the rotatable panel 50 for exposing and accessing the fasteners 262 attached to the mounting panel 26. A power supply 526 and a pair of electrically conductive pins 522 are attached to an inner side of the main body 52 of the rotatable panel 50. The electrically conductive pins 522 connect to positive and negative electrodes of the power supply 526 respectively, via wires 524.

Figure 3:
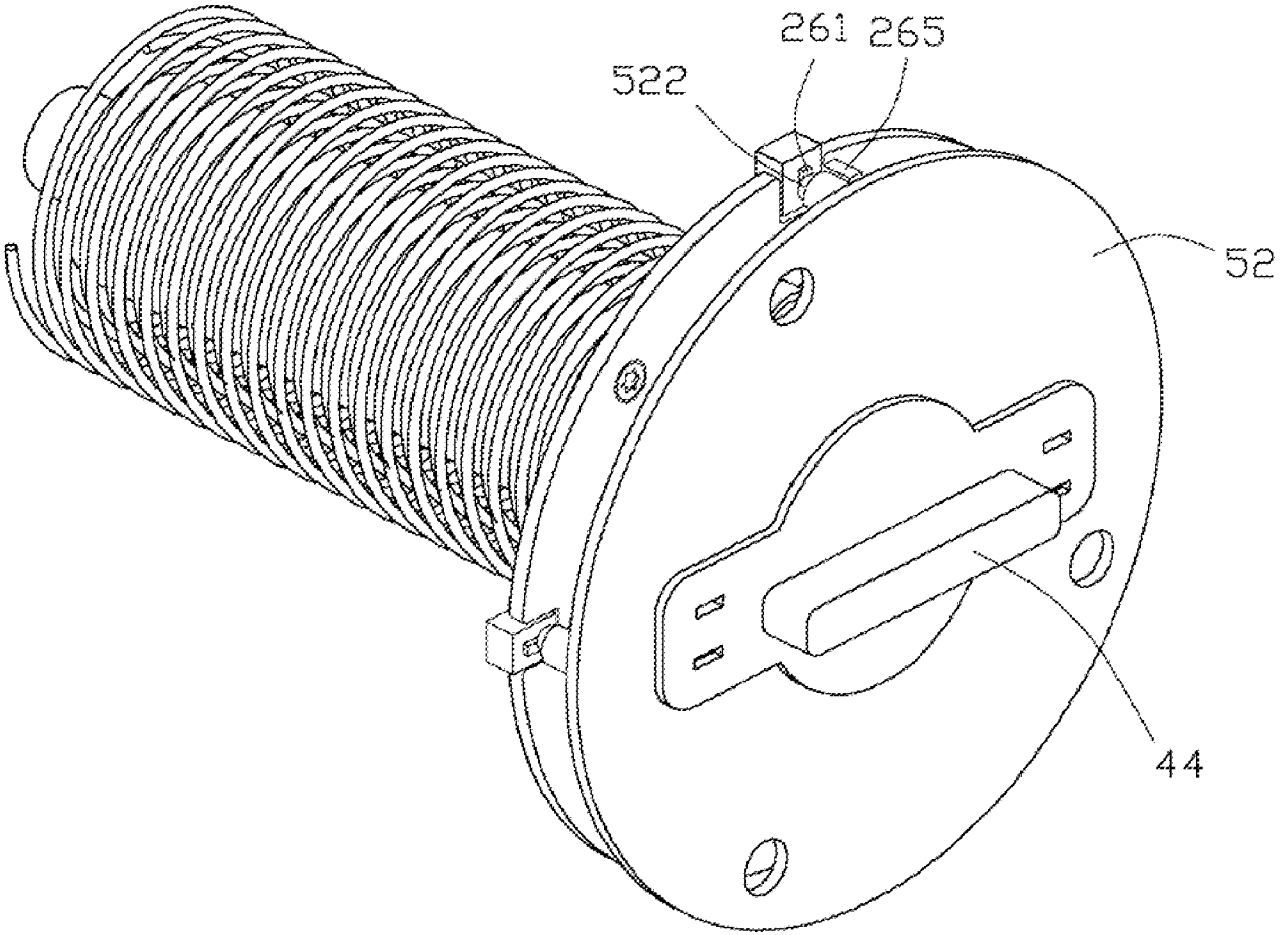
FIG. 3 is an assembly view of the electromagnet module and the rotatable module of FIG. 1, showing the rotatable module electrically connected to the electromagnet module.
Figure 4:
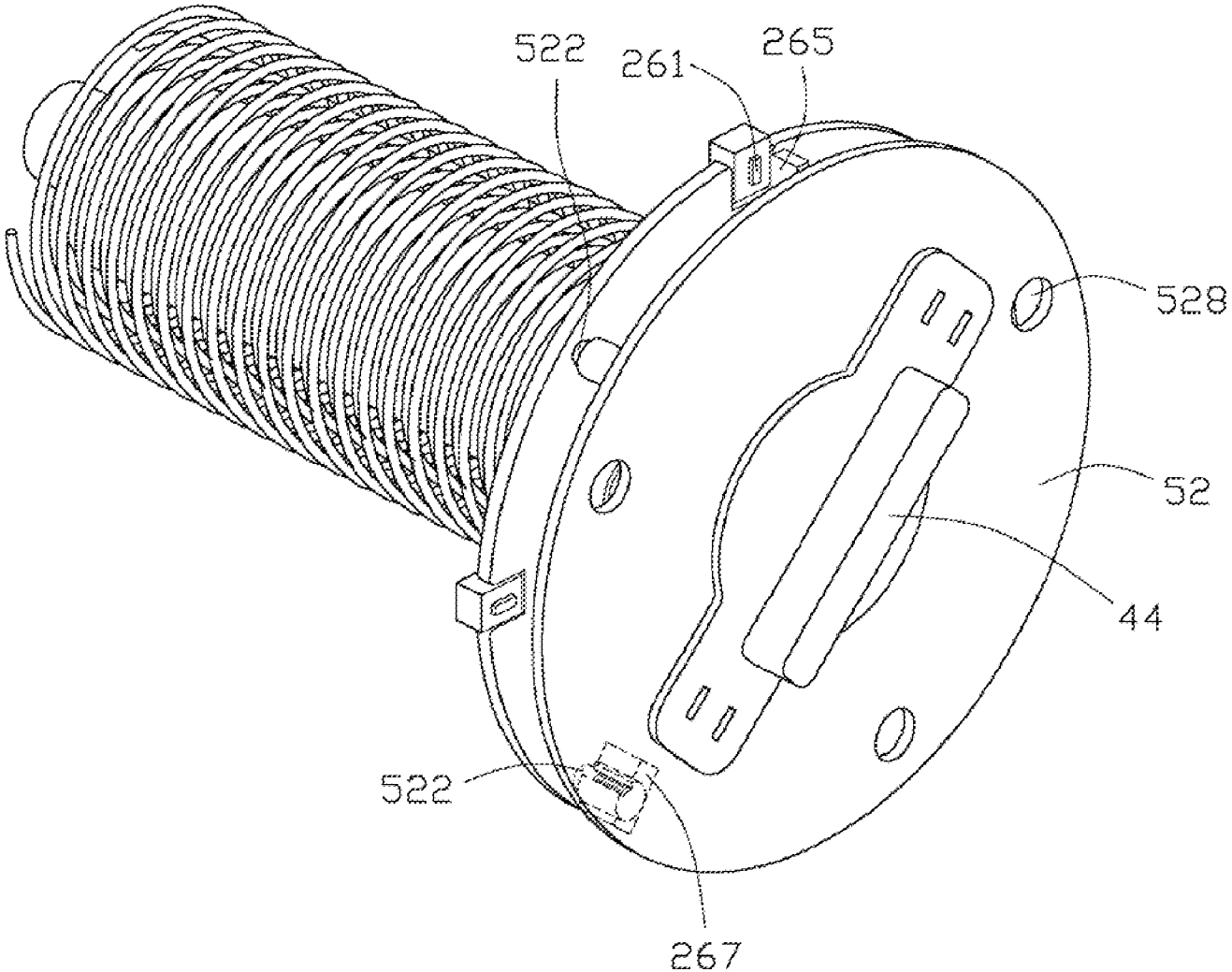
FIG. 4 is similar to FIG. 3, but showing the rotatable module electrically disconnected from the electromagnet module.
Figure 5:
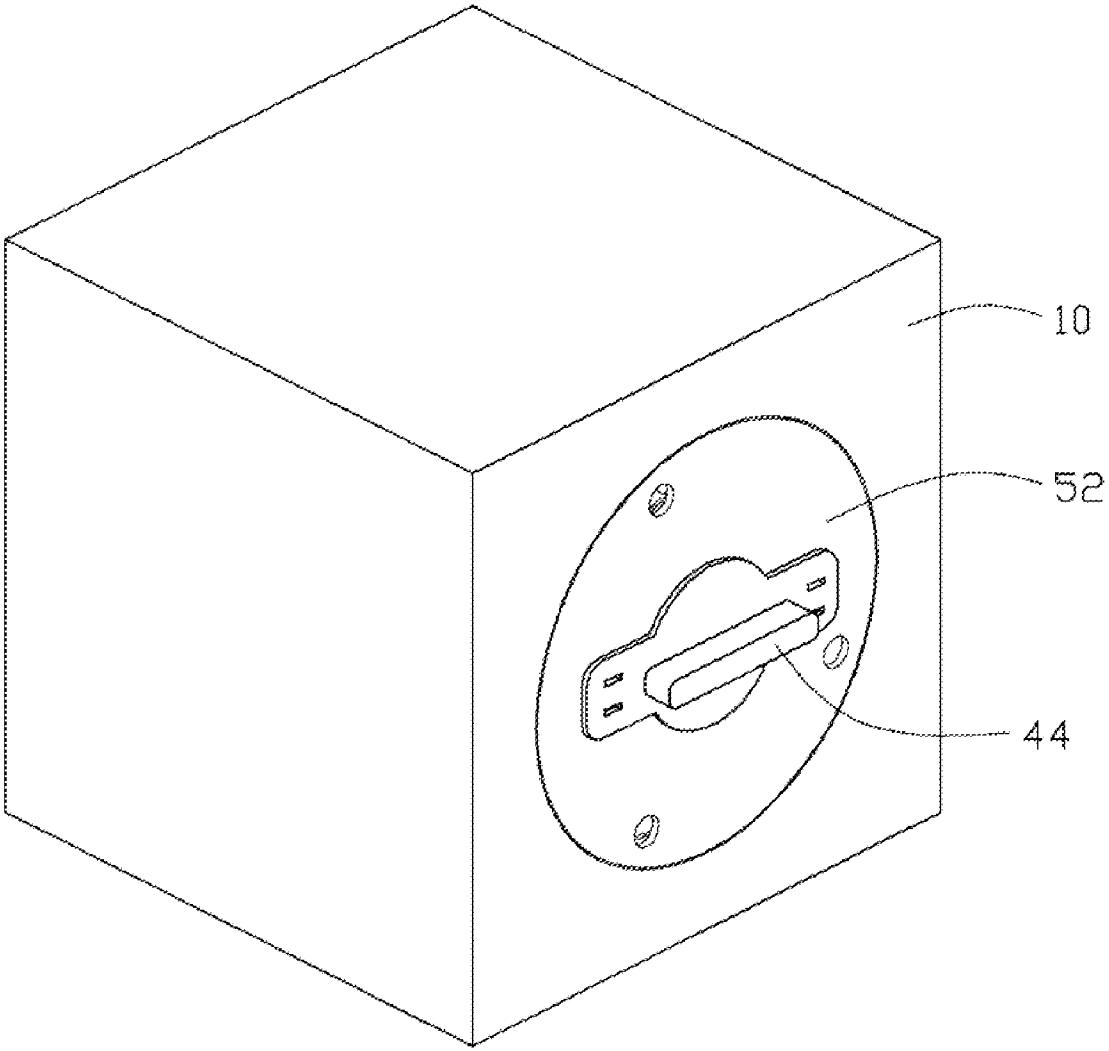
FIG. 5 is an assembly view of FIG. 1.

Referring to FIGS. 3-5, during assembly, the second hooks 42 of the control 40 engage the mounting holes 521 of the rotatable panel 50, securing the control 40 thereto. The first hooks 263 of the electromagnet module 20 rotatably engage the circular guideway 541 in the cylinder 54 of the rotatable panel 50. Then the rotatable module 30 is rotatably attached to the electromagnet module 20. The coil 22 together with the core 24 therein is received in the receiving hole 12 of the metal holder 10. The mounting panel 26 and the rotatable panel 50 are received in the annular lip 14 of the metal holder 10. The main body 52 of the rotatable panel 50 and one side surface 11 of the metal holder 10 are on a smooth plane. The fasteners 262 attached to the mounting panel 26 engage the securing holes 141 of the metal holder 10, securing the electromagnet module 20 to the metal holder 10.

When the rotatable module 50 is rotated to a first position (see FIG. 3), the electrically conductive pins 522 of the rotatable panel 50 contact the electrically conductive blocks 261, and one of the electrically conductive pins 522 of the rotatable panel 50 abuts the first limiting member 265 of the mounting panel 26 fro preventing the rotatable panel 50 from further rotation clockwise. The power supply 526 supplies power to the coil 22. A current flows in the coil 22 and the core 24 and the metal holder 10 are magnetized and capable of attaching metal objects, such as a metal frame of a server.

When the rotatable module 50 is rotated to a second position (see FIG. 4), the electrically conductive pins 522 of the rotatable panel 50 disconnect from the electrically conductive blocks 261, and one of the electrically conductive pins 522 of the rotatable panel 50 abuts the second limiting member 267 of the mounting panel 26, preventing the rotatable panel 50 from further rotating counterclockwise. The coil 22 is electrically disconnected from the power supply 526 with no current flows therethrough. The core 24 and metal holder 10 are demagnetized, thereby releasing the metal objects therefrom.

While the disclosure has been illustrated by the description of preferred embodiments thereof, and while the preferred embodiments have been described in considerable detail, it is not intended to restrict or in any way limit the scope of the appended claims to such details. Additional advantages and modifications within the spirit and scope of the disclosure will readily appear to those skilled in the art. Therefore, the disclosure is not limited to the specific details and illustrative examples shown and described.

What is claimed is:

1. An electromagnetic attachment apparatus comprising:

a power supply;

an electromagnet module comprising a coil, a core positioned inside the coil, and a mounting panel attached to the core, a pair of electrically conductive blocks attached to the mounting panel and electrically connected to the coil; and a rotatable module rotatably attached to the mounting panel, the rotatable module comprising a pair of electrically conductive pins connected to positive and negative electrodes of the power supply;

wherein the rotatable module is rotatable to a first position where the electrically conductive pins thereof contact the electrically conductive blocks for attaching a metal object, or a second position where the electrically conductive pins thereof disengage from the electrically conductive blocks for releasing the metal object.

2. The electromagnetic attachment apparatus of claim 1, further comprising a metal holder to which the mounting panel of the electromagnet module is secured, wherein when the rotatable module is rotated to the first position, the metal holder is magnetized and capable of attaching the metal object thereon.

3. The electromagnetic attachment apparatus of claim 2, wherein the metal holder is cuboid and defines an annular lip and a receiving hole therein, the mounting panel is received in the annular lip, and the coil together with the core is received in the receiving hole.

4. The electromagnetic attachment apparatus of claim 3, wherein a diameter of the annular lip exceeds that of the receiving hole.

5. The electromagnetic attachment apparatus of claim 1, wherein the rotatable module comprises a rotatable panel rotatably attached to the mounting panel and a control attached to an outer side of the rotatable panel, wherein the electrically conductive pins are positioned at an inner side of the rotatable panel.

6. The electromagnetic attachment apparatus of claim 5, wherein a cylinder protrudes from the inner side of the rotatable panel, in which a circular guideway is formed, and the mounting panel comprises a plurality of first hooks protruding therefrom for rotatably engaging the circular guideway.

7. The electromagnetic attachment apparatus of claim 5, wherein the control comprises at least a pair of second hooks, and at least one mounting hole is defined in the rotatable panel for engaging the second hooks and securing the control to the rotatable panel.

8. The electromagnetic attachment apparatus of claim 7, wherein the mounting panel comprises a first limiting member and a second limiting member, the first limiting member abuts one of the electrically conductive pins of the rotatable module when the rotatable module is rotated to the first position, and the second limiting member abuts another one of the electrically conductive pins when the rotatable module is rotated to the second position.

9. An electromagnetic attachment apparatus comprising:

a metal holder with a receiving hole defined therein;

an electromagnet module secured to the metal holder, comprising a coil received in the receiving hole of the metal holder and a core positioned inside the coil; and a rotatable module attached to the electromagnet module and rotatable to a first position wherein current passes through the coil and the metal holder is capable of attaching a metal objects thereon, or a second position wherein no current passes through the coil and the metal object is released from the metal holder.

10. The electromagnetic attachment apparatus of claim 9, wherein a power supply is attached to the rotatable module, electrically connected to the coil when the rotatable module is rotated to the first position, and electrically disconnected from the coil when the rotatable module is rotated to the second position.

11. The electromagnetic attachment apparatus of claim 10, wherein the electromagnet module further comprises a non-conductive mounting panel attached to one end of the core, and the rotatable module comprises a rotatable panel rotatably attached to the mounting panel.

12. The electromagnetic attachment apparatus of claim 11, wherein a pair of electrically conductive pins is attached to an inner side of the rotatable panel and electrically connects to positive and negative electrodes of the power supply respectively, and a pair of electrically conductive blocks is attached to the mounting panel and electrically connects to the coil; whereby when the rotatable member is rotated to the first position, the electrically conductive pins contact the electrically conductive blocks; and when the rotatable module is rotated to the second position, the electrically conductive pins disconnect from the electrically conductive blocks.

13. The electromagnetic attachment apparatus of claim 11, wherein the rotatable module further comprises a control attached to the rotatable panel.

14. The electromagnetic attachment apparatus of claim 13, wherein a cylinder protrudes from the inner side of the rotatable panel in which a circular guideway is formed, and the mounting panel has a plurality of hooks protrudes therefrom for rotatably engaging the circular guideway.

* * * * *